United States Patent [19]

Miller et al.

[11] Patent Number: 4,596,647

[45] Date of Patent: Jun. 24, 1986

[54] ELECTROLYSIS CELL FOR REPROCESSING PLUTONIUM REACTOR FUEL

[75] Inventors: William E. Miller, Naperville; Martin J. Steindler, Park Forest; Leslie Burris, Naperville, all of Ill.

[73] Assignee: The United States of America as represented by the United States Department of Energy, Washington, D.C.

[21] Appl. No.: 688,669

[22] Filed: Jan. 4, 1985

[51] Int. Cl.[4] ..... C25C 7/00

[52] U.S. Cl. ..... 204/212; 204/225

[58] Field of Search ..... 204/212, 225

[56] References Cited

U.S. PATENT DOCUMENTS

| | | | |
|---|---|---|---|
| 2,951,793 | 9/1960 | Hansen | 204/1.5 |
| 2,994,650 | 8/1961 | Slatin | 204/64 |
| 3,024,172 | 3/1962 | McLain, Jr. | 204/1.5 |
| 3,029,193 | 4/1962 | Dean | 204/1.5 |
| 3,052,611 | 9/1962 | Piper | 204/1.5 |
| 3,098,028 | 7/1963 | Mullins, Jr. | 204/245 |
| 3,282,806 | 11/1966 | Long | 204/1.5 |
| 3,377,257 | 4/1968 | Kolodney | 204/1.5 |

*Primary Examiner*—T. M. Tufariello

*Attorney, Agent, or Firm*—William Lohff; James W. Weinberger; Judson R. Hightower

[57] ABSTRACT

An electrolytic cell for refining a mixture of metals including spent fuel containing U and Pu contaminated with other metals, the cell including a metallic pot containing a metallic pool as one anode at a lower level, a fused salt as the electrolyte at an intermediate level and a cathode and an anode basket in spaced-apart positions in the electrolyte with the cathode and anode being retractable to positions above the electrolyte during which spent fuel may be added to the anode basket and the anode basket being extendable into the lower pool to dissolve at least some metallic contaminants, the anode basket containing the spent fuel acting as a second anode when in the electrolyte.

8 Claims, 1 Drawing Figure

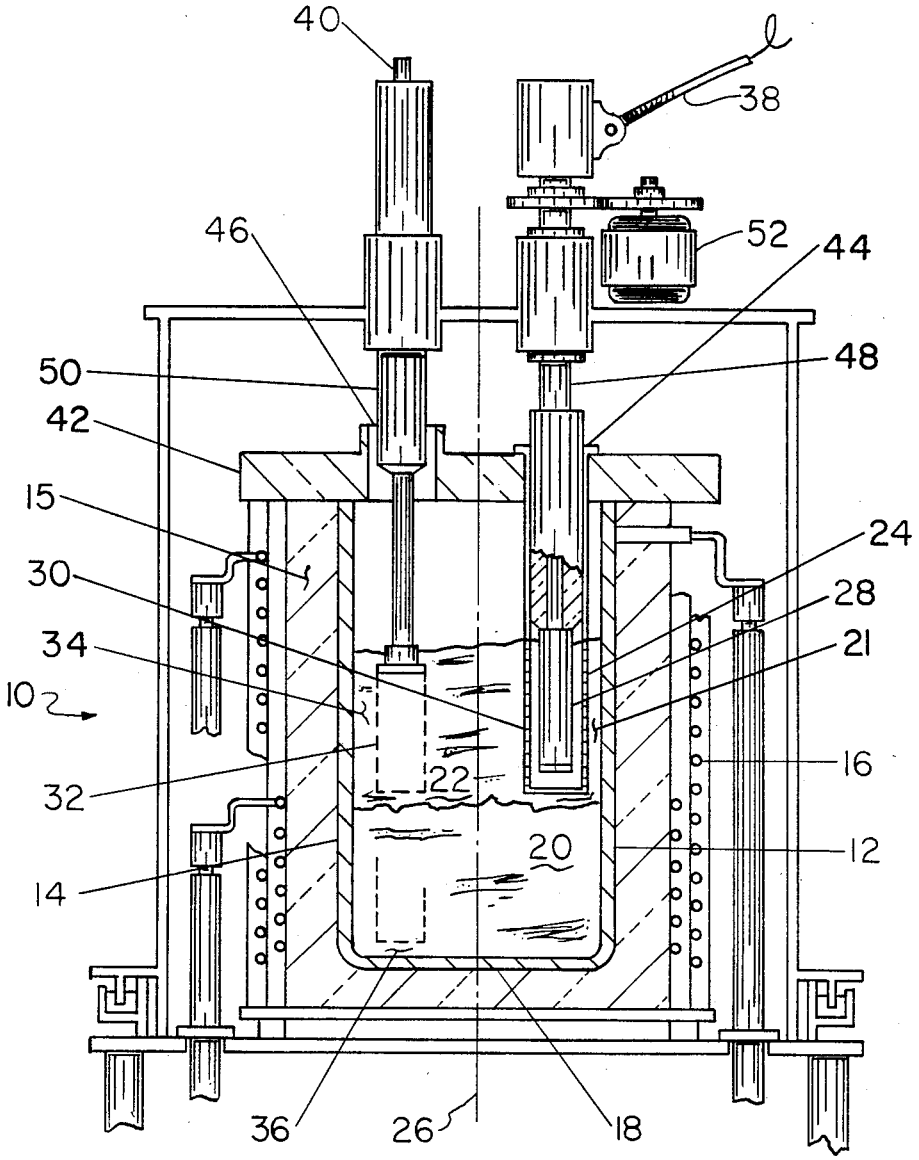
40
38
46
52
44
50
48
42
15
24
30
28
34
21
10
16
32
22
20
12
14
36
26
18

ELECTROLYSIS CELL FOR REPROCESSING PLUTONIUM REACTOR FUEL

CONTRACTUAL ORIGIN OF THE INVENTION

The United States Government has rights in this invention pursuant to Contract No. W-31-109-ENG-38 between the U.S. Department of Energy and Argonne National Laboratory.

BACKGROUND OF THE INVENTION

This invention relates to electrolytically refining mixtures of metals to recover predetermined metals and more particularly to the refining of a spent fuel utilizing a sequence of anode zones.

Electrorefining has been used in processes for recovering high purity metal or metals from an impure feed. In some instances, the electrorefining is carried out in an electrolysis cell in which the impure mixture forms the anode, the electrolyte is a fused salt of the metal or metals to be recovered plus an alkali metal halide, and the purified metal is recovered at the cathode. In some designs, the metal collected at the cathode collects at the bottom of the cell. In another proposed design as disclosed in U.S. Pat. No. 2,951,793, the anode is a liquid pool at the bottom of the cell and the cathode may be located above the anode.

While the anode pool has certain advantages, it is necessary for the spent fuel to be dissolved before the particular metal or metals may be transferred through the electrolyte to the cathode. In addition, the spent fuel usually has the outer cladding which is insoluble and tends to collect at the bottom of the cell. Accordingly, new designs of the cell are desirable to reduce the extent of some of these limitations in the general design.

SUMMARY OF THE INVENTION

Briefly, the invention is directed to an electrolytic cell for electrorefining a mixture of metals wherein the cell includes a pot to hold a metallic pool at a lower level, a fused salt as the electrolyte above the metallic pool, a cathode extending in the fused salt, and one or more retractable anode baskets for holding spent fuel mounted above the electrolyte and extendable into the fused salt as an anode in direct contact with the electrolyte in a first anode zone and extendable into the pool as a second anode zone. Both the metallic pool and anode basket or baskets are electrically connected as anodes and may act separately when the basket is in the first zone. Some of the advantages of the inventive cell are (1) the fuel is in direct contact with the electrolyte in the first zone, (2) as the process continues, the fuel may be dissolved in the pool in the second zone, (3) the undissolved cladding may be removed with the basket without requiring a shutdown of the process, and (4) the cathode may be retractable to recover the metal collected at the cathode.

BRIEF DESCRIPTION OF THE DRAWINGS

In the drawings:

FIG. 1 is a sectional view of an electrolytic cell as one embodiment of the invention.

DETAILED DESCRIPTION OF THE PREFERRED EMBODIMENT

The spent fuel is a mixture of U and Pu contaminated with one or other metals such as Mo, Ru, Rh, Fe, Cr, Zr, Cd, Pd and Pt. Usually, a portion of the outer cladding is also present with the cladding being stainless steel which is not dissolvable in the anode pool. The spent fuel is provided as small disc-like sections cut from a fuel rod to expose the spent fuel.

As illustrated in FIG. 1, the cell 10 includes a metallic pot 12 preferably constructed of an iron alloy. About the outer wall 14 and insulation 15 (typically $Al_2O_3$-$SiO_2$) are induction coils 16 for heating the pot and contents to temperatures in the order of about 450°-500° C. Pot 12 is closed at the bottom portion 18 to hold an anode pool 20 containing a diluent metal and dissolved components of the spent fuel. Above the anode pool 20 in an intermediate portion of the pot is the electrolyte 22 which is composed of one or more alkali metal halides and halide salts of the metal or metals to be recovered. Preferably, the alkali metal halide salt is eutectic salt of $CaCl_2$-$BaCl_2$-LiCl (approximately 28.8-16.5-54.7 mole %) with a melting temperature of about 400° C., plus the chloride salts of Pu and U. One or more cathodes 24 extend into the electrolyte 22 for collecting the metal or metals to be purified. As illustrated, the cathodes are offset from the center 26 of pot 12 and are constructed with a central metallic rod 28 and an outer nonconductive, perforated cover 30. Each cathode 24 is retractable to collect the metal deposited on rod 28 without requiring a shutdown of the process.

One or more anode baskets 32 also extend into the electrolyte 22 in a first anode zone 34 and are further extendable into the anode pool 20 as a second anode zone 36. In the first zone 34, the spent fuel is in direct contact with the electrolyte and the transfer of exposed metal into the electrolyte 22 may occur at a reasonably rapid rate. As the amount of exposed metal becomes depleted, the basket 32 is lowered into the second zone 36 where the remaining spent fuel is dissolved. Any metals insoluble in the metallic pool 20 may be removed with the basket 32 as it is retracted for fresh feed.

As illustrated, cathode 24 and anodes 20 and 32 are connected to power sources 38 and 40. Cover 42 on pot 12 provides openings 44 and 46 through which the retraction linkages 48 and 50 extend into pot 12. Motor 52 is provided for rotation of cathode 24.

Representative metals of construction are mild steel for the pot and adjacent parts, and an alloy of molybdenum-tungsten for the cathode. Preferably, the anode pool includes cadmium which acts as a buffer for the steel to avoid removal of iron as the cell voltage increases. At the higher voltages (in the order of 1 volt) from the initial 0.1 volt, the cadmium is transferred to the cathode and being liquid, flows back to the anode pool.

The spent fuel typically may contain about 10 wt. % fission products and 90 wt. % of U-Pu-Zr in a weight ratio of about 75-15-10. Discs of approximately 0.280 in. O.D. and 0.280 in. long cut from the fuel rod serve as the source of U-Pu-Zr.

In the operation of the cell, some metals such as Pd, Rh and Ru will dissolve in the anode pool (which is being stirred) while others such as Zr are only slightly soluble and those such as Mo are insoluble. Metals not soluble are recovered by retracting the anode basket which carries some Cd in the nonperforated lower portion. Alkali, alkaline earth, and rare earth metals usually dissolve in the electrolyte.

The foregoing description of embodiments of the invention has been presented for purposes of illustration and description. It is not intended to be exhaustive or to limit the invention to the precise form disclosed, and obviously many modifications and variations are possible in light of the above teaching.

The embodiments of this invention in which an exclusive property or privilege is claimed are defined as follows:

1. An electrolytic cell for refining a spent nuclear fuel and comprising a metallic pot including walls forming a lower zone for retaining a lower molten pool containing the spent nuclear fuel and an intermediate zone for retaining a molten salt electrolyte floating on the molten pool, electrode means including at least one anode and cathode, means for extending the anode into the intermediate and lower zones and the cathode into the intermediate zone, and means for retracting the anode to the intermediate zone apart from the cathode and to above the intermediate zone, and electrical power means connected to the anode, molten pool and cathode for providing electrical power to the cell.

2. The cell of claim 1 wherein the anode includes a metallic basket for holding spent fuel.

3. The cell of claim 2 wherein the metal of the pot is an iron alloy.

4. The cell of claim 3 wherein the cathode is retractable to above the intermediate zone.

5. The cell of claim 4 including means for rotating the cathode during operation of the cell.

6. The cell of claim 5 including said molten pool and electrolyte.

7. The cell of claim 6 including means for heating the pool and electrolyte to a temperature in the range of 450°-500° C.

8. The cell of claim 6 wherein the anode is composed of U and Pu contaminated with alkali, alkaline earth and rare earth metals.

* * * * *